US006029573A

United States Patent [19]

Capdeboscq

[11] Patent Number: 6,029,573

[45] Date of Patent: Feb. 29, 2000

[54] MULTIFUNCTIONAL INKING STATION FOR A FLEXOGRAPHIC PRINTING MACHINE

[75] Inventor: Bernard Capdeboscq, St Just-Chaleyssin, France

[73] Assignee: Bobst, S.A., Lausanne, Switzerland

[21] Appl. No.: 09/095,629

[22] Filed: Jun. 10, 1998

[30] Foreign Application Priority Data

Jun. 19, 1997 [CH] Switzerland ..... 97-07883

[51] Int. Cl.[7] ..... B41F 31/00

[52] U.S. Cl. ..... 101/350.6; 101/350.4; 101/351.3

[58] Field of Search ..... 101/202, 205–210, 101/161, 314, 315, 364, 367, 348, 329–331, 349.1, 350.1, 350.4, 350.5, 350.6, 351.6, 351.1, 351.3, 351.4

[56] References Cited

U.S. PATENT DOCUMENTS

| | | | |
|---|---|---|---|
| 3,908,545 | 9/1975 | Simeth | 101/350 |
| 4,041,864 | 8/1977 | Dahlgren et al. | 101/350.4 |
| 4,211,167 | 7/1980 | Corse | 101/350.5 |
| 4,497,250 | 2/1985 | Dressler | 101/350 |
| 4,526,102 | 7/1985 | Grobman . | |
| 4,627,350 | 12/1986 | Sato | 101/169 X |
| 5,027,513 | 7/1991 | Allison . | |
| 5,103,732 | 4/1992 | Wells et al. | 101/157 X |
| 5,184,556 | 2/1993 | Schaeuble | 101/483 |
| 5,239,925 | 8/1993 | Bobo | 101/366 |
| 5,243,907 | 9/1993 | Weishew . | |
| 5,406,887 | 4/1995 | Hertel et al. | 101/366 |

FOREIGN PATENT DOCUMENTS

| | | |
|---|---|---|
| 0382347 | 1/1990 | European Pat. Off. . |
| 0368485 | 5/1990 | European Pat. Off. . |
| 0382347 | 8/1990 | European Pat. Off. . |
| 2687096 | 1/1993 | France . |

*Primary Examiner*—Kimberly Asher
*Attorney, Agent, or Firm*—Allen N. Friedman; McCarter & English, L.L.P.

[57] ABSTRACT

The disclosed multifunctional inking station comprises a plate cylinder (2), a textured cylinder (3) and means for supplying a determined quantity of ink to the textured cylinder (3). The means for supplying a determined quantity of ink to the textured cylinder (3) comprises at least two chambered doctor blade units (4,5), placed facing one another on either side of the textured cylinder (3). The textured cylinder (3) in use is always the same whatever kind of printing work to be performed may be. Use of one or the other of said chambered doctor blade units (4,5) can be selected in accordance with the kind of printing work to be performed without having to replace the textured cylinder (3).

6 Claims, 5 Drawing Sheets

MULTIFUNCTIONAL INKING STATION FOR A FLEXOGRAPHIC PRINTING MACHINE

RELATED APPLICATIONS

This Application claims priority from French application No. 97-07883 filed on Jun. 19, 1997.

BACKGROUND OF THE INVENTION

1. Field of the Invention

The present invention refers to a multifunctional inking station for a flexographic printing machine, more particularly for a flexographic printing machine adapted to print web-like or plate-like workpieces such as webs or sheets of paper, cardboard or corrugated cardboard.

2. Description of the Background Art

Flexographic printing machines that are known up to now generally comprise a printing station including a plate cylinder to which the ink is transferred by means of a textured cylinder, which is better known in the art as an "anilox cylinder". The surface of this textured cylinder includes a plurality of cells, the density and distribution of which depend on the kind of printing work to be performed. This textured cylinder can be supplied with ink in more ways than one. A first way to supply this textured cylinder with ink is to contact it with a pad roller. The ink is supplied by means of a pump in an area located above the contact point between the textured cylinder and the pad roller. The ink is thereby layered between these two devices so as to wipe the textured cylinder, leaving ink only in its cells. This solution is suitable for most of the current printing work not requiring a high-grade quality. However, this arrangement allows medium quality printing of large plain surfaces called "tint blocks" by workers in the art.

Instead of supplying ink in the area above the contact point between the textured cylinder and the pad roller an alternate arrangement makes use of a transfer roller soaking in an ink fountain. In this case, the transfer roller deposits the ink on the pad roller at a point located before the contact point between the textured cylinder and the pad roller. Such an arrangement is, among others, described in the patent U.S. Pat. No. 4,526,102.

Another way to supply ink to the textured cylinder is to contact it with a chambered doctor blade. This chambered doctor blade consists of a chambered doctor blade body in the form of a U-shaped hollow bar whose part facing the textured cylinder comprises two doctor blades and whose two ends are sealed by two sealed joints. In this case, the ink is introduced into the chambered doctor blade body by means of a pump. The doctor blade is placed at a circumferential position in the direction of rotation of the textured cylinder, between the textured cylinder and its contact point with the printing plate cylinder. This will act to limit the amount of ink film deposited on the textured cylinder so that the ink only remains in the cells of the textured cylinder. The other doctor blade constitutes a prescraping and sealing means for the chambered doctor blade.

The utilization of a chambered doctor blade incorporating a metallic blade is particularly suited to produce work for which a high-grade printing quality is required. Effectively, due to the stiffness qualities of the doctor blades, it is easy to control very exactly the thickness of the ink film to be deposited on the textured cylinder. On the other hand, this method has the drawback of not being able to ensure a good quality for the printing of large surfaces ("tint blocks") since it does not allow supply of enough ink to the textured cylinder. Also, for the printing of large "tint blocks" it would be necessary to replace the textured cylinder by another cylinder a greater number of cells.

The wiping of the ink film on the textured cylinder depends, among other factors, on the material employed for the doctor blades, on their thickness, and on the angle at which the doctor blades are placed at their contact point with the textured cylinder. In order to improve the printing of large surfaces ("tint blocks"), workers in the art have tested and finally chosen thicker doctor blades, made of a plastic material as it is described in the patent U.S. Pat. No. 5,027,513. This solution, although better than the pad roller, has substantially the same drawbacks when requiring a high-grade printing quality for fine works which only include small "tint blocks" without changing the textured cylinder.

In order to improve the printing quality in accordance with the kind of work to be produced, the combined use of a pad roller inking station and a doctor blade inking station has been suggested. Such a combination is described in the patent EP 0 382 347 B1. The result obtained depends, however, on the drawbacks arising from the use of the inking station including a pad roller. The solution resulting from the combination has certainly allowed improve printing quality by enabling easy change from one printing mode to the other printing mode, in accordance with the work to be performed, but presents not inconsiderable drawbacks with respect to the cost of producing the station. Another drawback that should be noted lies in the fact that it is not possible to use substantially identical devices for making the inking station and that in most cases it would be necessary to change the textured cylinder, which is a difficult dismounting operation.

The object of the present invention is aimed at eliminating entirely or partly, the abovementioned drawbacks.

SUMMARY OF THE INVENTION

With this objective, the invention is directed to a multifunctional inking station for a flexographic printing machine, more particularly for a flexographic printing machine adapted to print web-like or plate-like workpieces such as webs or sheets of paper, cardboard or corrugated cardboard. The inking station comprises a plate cylinder, a textured (anilox) cylinder, and means for supplying a determined quantity of ink to the textured cylinder. The means for supplying a determined quantity of ink on the textured cylinder includes at least two chambered doctor blade units, placed facing one another on either side of the textured cylinder. This novel arrangement permits the textured cylinder in use to always be the same whatever the kind of printing work is to be produced and permits one or the other of the chambered doctor blade units to be optionally selected in accordance with the kind of printing work to be performed. In addition, the ability to optionally select which chambered doctor blade unit to use eliminates the need to replace the textured cylinder in order to produce a different kind of printing job.

Preferably, one of the chambered doctor blade units is a chambered doctor blade equipped with doctor blades allowing almost complete wiping of the surface of the textured cylinder and the other chambered doctor blade unit is a chambered doctor blade unit equipped with doctor blades adapted for leaving a determined thickness of ink film on the surface of the textured cylinder.

Preferably, the chambered doctor blade unit allowing almost complete wiping of the surface of the textured cylinder is a chambered doctor blade unit equipped with steel doctor blades. According to another feature of the invention, the chambered doctor blade unit adapted for leaving a determined thickness of ink film on the surface of the textured cylinder is a chambered doctor blade unit equipped with plastic doctor blades.

In another advantageous embodiment, the doctor blades of both chambered doctor blade units are made up of plastic material having low coefficient of friction. Advantageously, the contact pressure of the doctor blades of the chambered doctor blade unit adapted for leaving a determined thickness of ink film on the circumference of the textured cylinder is controlled in accordance with the operating speed of the printing machine so as to control the thickness of the ink film supplied to the textured cylinder.

Other features and advantages of this invention will become evident from the following description, based on the enclosed drawings, which illustrate, schematically and by way of example, an embodiment of the inventive inking station.

DETAILED DESCRIPTION OF THE INVENTION

Figure 1:
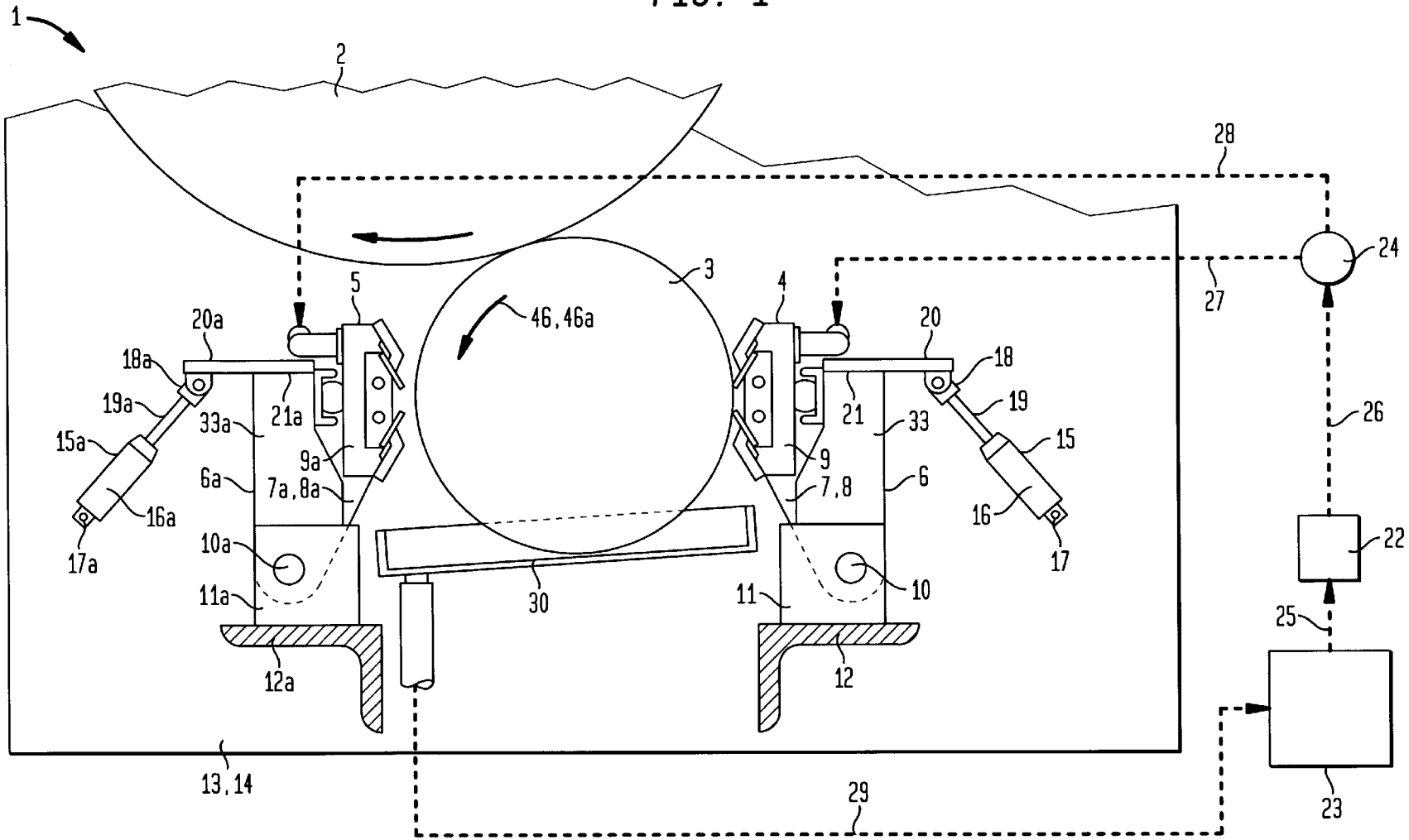
FIG. 1 is a schematic elevational view of an exemplary inking station.

FIG. 1 is a schematic view of an inking station 1, for a flexographic printing machine, comprising a plate cylinder 2 in contact with a textured cylinder 3, associated with a first chambered doctor blade unit 4 and a second chambered doctor blade unit 5. It should be noted that the use of more than two chambered doctor blade units might be considered. The textured cylinder 3 is selected such that it includes a number of cells corresponding to a textured cylinder used for fine printing work, not including large "tint blocks". The first chambered doctor blade unit 4 is mounted on a support 6 consisting of two levers 7 and 8 placed at either end of a crossbar 33. The levers 7, 8 pivot around an axis 10 supported by a bracket 11 attached to a beam 12 extending between two lateral frames 13, 14 of the inking station 1. The pivoting of the levers 7 and 8 is performed by a pneumatic or a hydraulic cylinder 15 the body 16 of which is attached to a stud 17 against the inner surface of the lateral frames 13 and 14, so as to be rotatable to a slight extend. The head 18 of the shaft 19 of the pneumatic or hydraulic cylinder 15, is connected to a lug 20 on the upper part 21 of each lever 7 and 8 by means of screws, not represented in this figure. The second chambered doctor blade unit 5 is mounted in similar manner by identical elements, which have the same reference numerals completed with the designation "a". In the example illustrated in FIG. 1, only the first chambered doctor blade unit 4 is in contact with the textured cylinder 3. This corresponds to use of the inking station 1 for fine works, only including small "tint blocks".

The supply of ink to the first and second chambered doctor blade units 4, 5 is performed by a commercially available ink pump 22, of well known construction. The ink pump draws the ink from a tank 23 and directs it toward the first and second chambered doctor blade units through a valve 24 and through pipes 25,26, 27, 28. Ink recovery is accomplished by gravity feed through the pipe 29 connected at one end to a pan 30 and at the other end to the tank 23. The pan 30 extends across the whole length of the textured cylinder 3 and is supported, by means not represented, between the two lateral frames 13, 14. Obviously, in order to simplify cleaning when a change of the color is desired, a tank, a pump and independent ducts for each of the first and second chambered doctor blade units 4, 5 could be used. The pneumatic or hydraulic cylinders 15, 15*a* are independently controlled according to whether the first or the second chambered doctor blade unit is to be employed. The cylinders 15, 15*a* are controlled, for example by means of a two-position switch electrically or pneumatically connected to a cylinder control circuit 13, 14. In the represented embodiment, the first and the second chambered doctor blade units 4, 5 are placed facing one another relative to a common axis passing through the center of rotation of the textured cylinder 3. However, it is obviously possible to position the first and second chambered doctor blade units 4, 5 on either side of the textured cylinder 3, in a different orientation relative to the center of rotation of the textured cylinder 3, in such a manner that the chambered doctor blade units 4, 5 are always facing one another.

Figure 2:
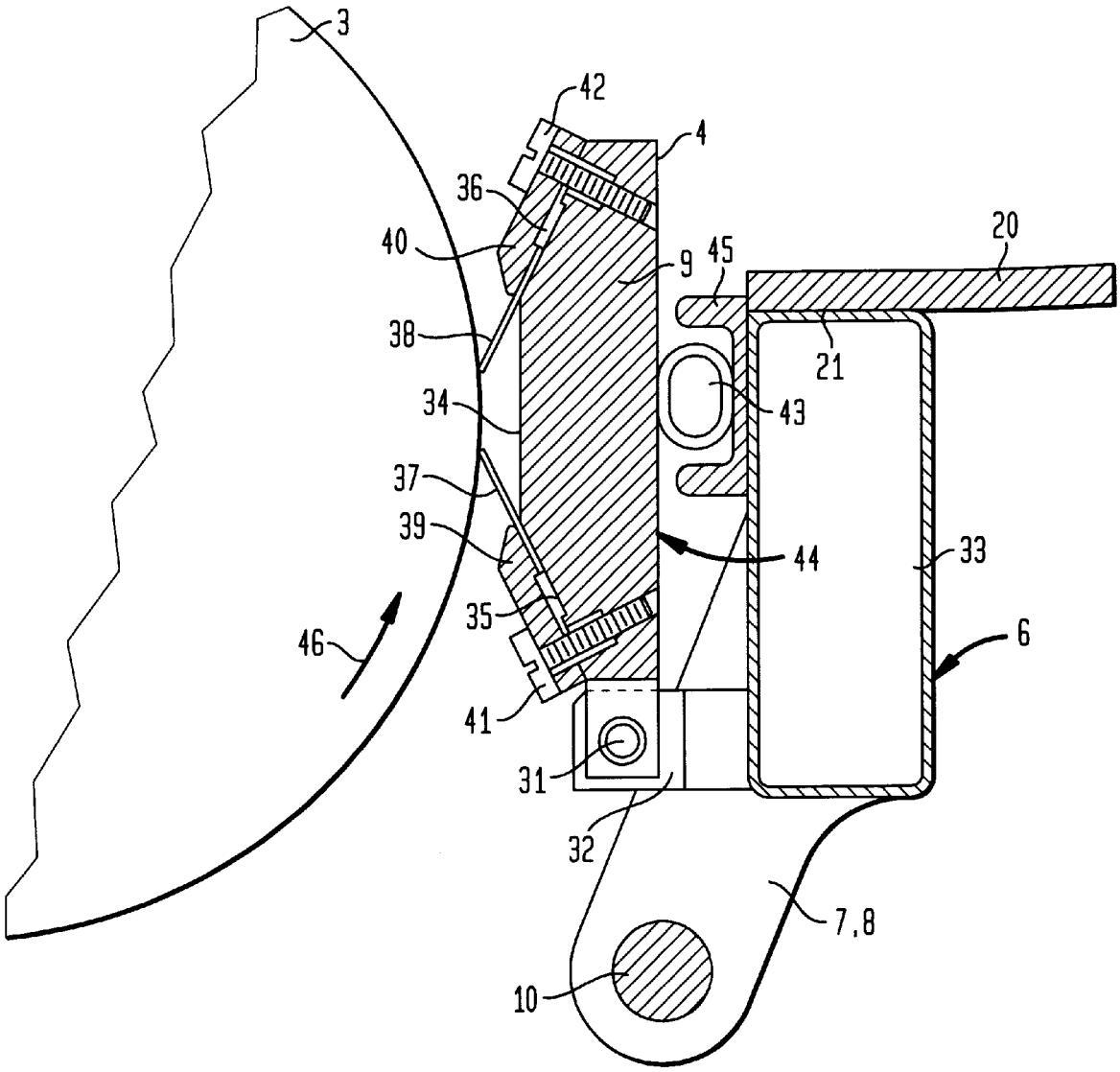
FIG. 2 is schematic view partially in section of a first chambered doctor blade unit.

FIG. 2 is a schematic view, partially in section, of a first chambered doctor blade unit 4 adapted to be put into operation when fine work is to be executed, including only small "tint blocks". The chambered doctor blade unit 4 includes a chambered doctor blade body 9 consisting of, in the illustrated example, a transverse aluminum bar 33 pivotally mounted on an axis 31 between two fastening lugs 32 welded at each end of the crossbar 33 of the support 6. The surface 34 of the chambered doctor blade body 9 is machined so as to have two slanted planes 35, 36 on which the doctor blades 37, 38 will be placed. The doctor blades 37, 38 will be firmly clamped by means of small bars 39, 40 respectively fastened to the chambered doctor blade body 9 by means of screws 41, 42, distributed over the entire length of the chambered doctor blade body 9. In the illustrated exemplary embodiment, the selected position of the chambered doctor blade unit 4 is maintained on the one hand by an inflatable hose 43 acting on the rear part 44 of the chambered doctor blade body 9 and on the other hand by means for limiting and adjusting the position, of well-known construction and not represented. The inflatable hose 43 is placed in a U-shaped bar 45 welded against the crossbar 33 of the support 6. It must be noted that the doctor blades 37, 38 used in this example are metal, for example a steel shim with a thickness from 0.2 to 0.4 millimeters. The textured cylinder rotates in the direction shown by the arrow 46 and, consequently, it is the upper doctor blade 38 that will act as means for wiping (doctoring) the ink supplied to the textured cylinder 3 such that only the cells of the textured cylinder will be filled with ink.

Figure 3:
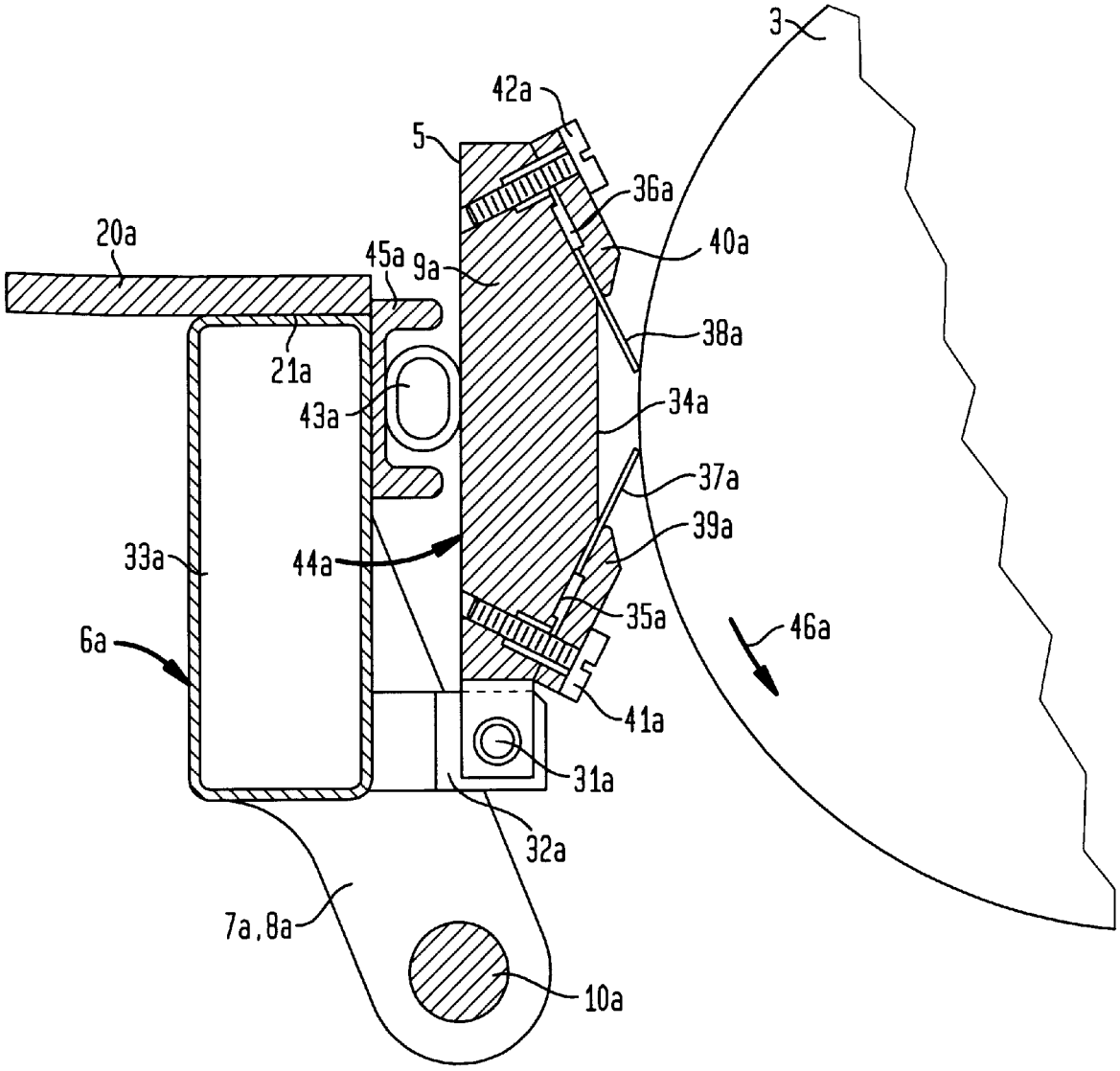
FIG. 3 is a schematic view partially in section of a second chambered doctor blade unit.

FIG. 3 is a schematic view, partially in section, of a second chambered doctor blade unit 5 adapted to be placed into operation if printing jobs including large "tint blocks" are to be executed. The chambered doctor blade unit 5 includes a chambered doctor blade body 9*a* consisting of, in the illustrated example, a transverse aluminum bar pivotally mounted on an axle 31*a* between two fastening lugs 32*a* welded to either end of the crossbar 33*a* of the support 6*a*. The surface 34*a* of the chambered doctor blade body 9*a* is machined to have two slanted planes 35*a*, 36*a* on which the doctor blades 37*a*, 38*a* will be placed. The doctor blades 37*a*, 38*a* will be firmly clamped by means of small bars 39*a*, 40*a*, fastened to the chambered doctor blade body 9*a* by means of screws 41*a*, 42*a*, distributed over the length of the chambered doctor blade body 9*a*. In the present embodiment, the selected position of the chambered doctor blade unit 5 is maintained on the one hand by an inflatable hose 43*a* acting on the rear part 44*a* of the chambered doctor blade body 9*a*, and by means for limiting and adjusting the position, of well-known construction not represented. The inflatable hose 43*a* is placed in a U-bar 45*a* welded against the crossbar 33*a* of the support 6*a*. It must be noted that the doctor blades 37*a*, 38*a* used in this example are of plastic, for example a plastic material having low coefficient of friction with a thickness from 0.8 to 1.6 millimeters. The textured cylinder rotates in the direction shown by the arrow 46*a*. Consequently, it is the doctor blade 37*a* that will act as the means for wiping the ink deposited on the textured cylinder 3. The use of plastic allows the doctor blades to let past a greater ink volume than the volume required to fill up the cells of the textured cylinder 3, i.e., to pass an ink film above the surface of the textured cylinder 3 (overinking). Obviously, it is possible to use chambered doctor blade units 4, 5 equipped only with plastic doctor blades by choosing plastic with different stiffness and different thickness, as well as by selecting a different contact angle for each of the chambered doctor blade units.

Figure 4:
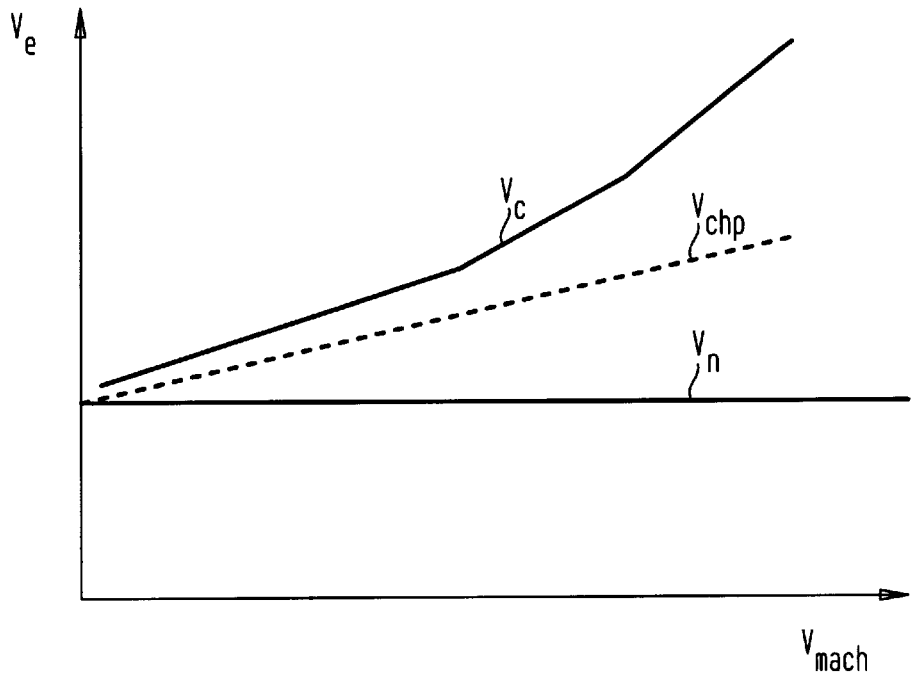
FIG. 4 is a graph showing the variation of the volume of ink supplied to the textured cylinder as a function of the rotational speed of the cylinder with a constant contact pressure of the doctor blades.

FIG. 4 is a graph showing the variation of the ink volume supplied to the textured cylinder 3 as a function of the rotational speed of the textured cylinder, with a constant contact pressure applied to the doctor blades 37*a*, 38*a*. The rotational speed of the textured cylinder of course depends on the operating speed of the printing machine. In this figure the value Vmach, which represents the operating speed of the printing machine, is plotted as the abscissa and the value Ve, which represents the ink volume supplied to the textured cylinder 3, is plotted as the ordinate. The curve Vn represents the nominal ink volume, i.e. the ink volume required to fill the cells of the textured cylinder. The curve Vc represents the variation of the overinking ink volume with constant pressure for a pad roller and the curve Vchp represents the variation of the overinking ink volume with constant pressure for a chambered doctor blade unit equipped with plastic doctor blades. These curves illustrate the general behavior of the quantities represented. A quantitave set of such curves for each particular inking station can be generated by methods well known to workers in the art.

Figure 5:
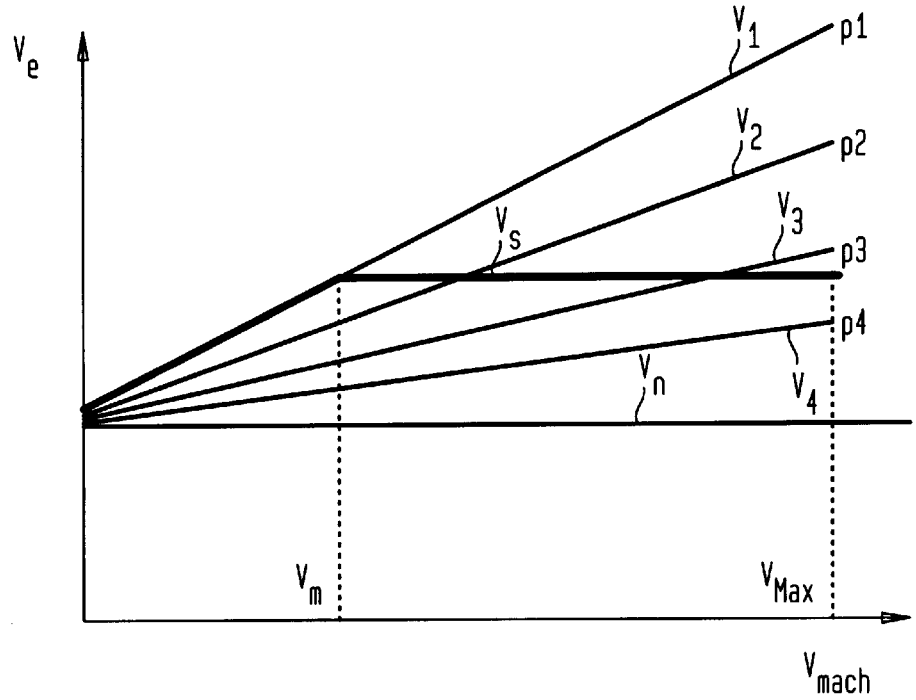
FIG. 5 is a graph showing the variation of the volume of ink supplied to the cylinder as a function of the rotational speed of the cylinder at different doctor blade contact pressures.

FIG. 5 is a graph showing the variation of the ink volume supplied to the textured cylinder as a function of the rotational speed of the cylinder, at different doctor blade 37*a*, 38*a* contact pressures. In this figure the value Vmach, which represents the operating speed of the printing machine, is plotted as the abscissa and the value Ve, which represents the ink volume supplied to the textured cylinder 3, is plotted as the ordinate. The curve Vn represents the nominal ink volume, i.e. the ink volume required to fill the cells of the textured cylinder. The curve V1 represents the variation of the overinking ink volume for a pressure p1, the curve V2 represents the variation of the overinking ink volume for a pressure p2, the curve V3 represents the variation of the overinking ink volume for a pressure p3 and the curve V4 represents the variation of the overinking ink volume for a pressure p4. The curve Vs represents the ink volume supplied to the textured cylinder 3 for a given overinking and illustrates how the pressure must be increased to maintain a constant overinking volume as the speed is increased. The contact pressure of the doctor blades 3 is produced, in the present example, by the action of an inflatable hose 43, 43*a*. The air pressure in the inflatable hose opposes the hydrodynamic pressure produced by the ink film, which varies with the rotational speed of the textured cylinder 3. If the cylinder speed increases, the thickness of the ink film increases. If the air pressure in the inflatable hose 43, 43*a* is increased, the thickness of the ink film will decrease. Thus, this pressure must be controlled with respect to the rotational speed of the textured cylinder 3 in order to control the thickness of the ink film. By using different pressures p1,p2,p3,p4, a family of curves V1,V2,V3,V4 corresponding to the different pressures is obtained. For a giving overinking, the pressure is varied in accordance with the rotational speed of the textured cylinder 3. A set of such curves for each particular inking station can be generated by methods well known to workers in the art.

Figure 6:
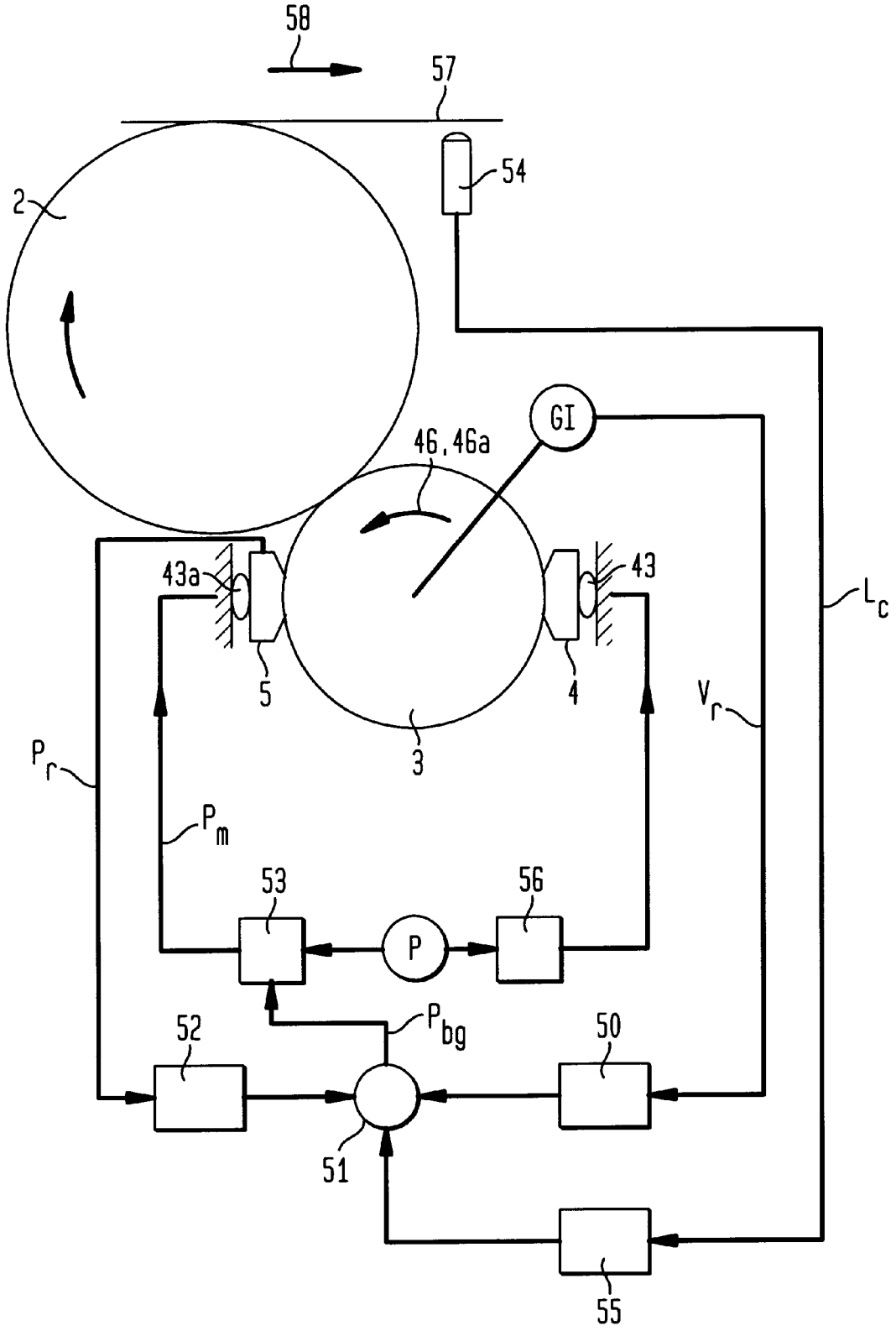
FIG. 6 is a block diagram of a control system for the contact pressure of the doctor blades.

FIG. 6 is a block diagram of a system for controlling the contact pressure of the chambered doctor blade units 4, 5. In this figure the chambered doctor blade unit 4 uses metallic doctor blades and the chambered doctor blade unit 5 uses plastic doctor blades. The latter is therefore used for producing printing jobs including large "tint blocks". As has previously been explained, the intent is to control the pressure of the plastic doctor blades against the textured cylinder 3 in accordance with the rotational speed of the latter. This control system includes a pulse generator GI mounted on the axle of the textured cylinder 3 so as to provide information Vr related to its rotational speed. This information Vr is transmitted to a decoder 50 then sent to a comparator 51. The contact pressure of the plastic doctor blades of the chambered doctor blade unit 5 is represented by the information Pr originating from a sensor such as, for example, a strain gauge. This information Pr is transmitted to a decoder 52 before being sent to the comparator 51. In the chosen example, the return loop of the control system circuit consists of a scanner 54, for example a densitometer, which will emit information Lc representing an indication related to the printing quality of the large "tint blocks". The information Lc is transmitted to a decoder 55 before being sent to the comparator 51. Here we have closed-loop control system. Obviously, it is also possible to work open-loop by removing the elements related to automatic control of the printing quality of the large "tint blocks" and hence the information Lc. The air pressure in the inflatable hose 43*a* is produced by means of a pump P and its magnitude is regulated by a pressure regulator 53. The pump P also supplies the inflatable hose 43 of the chambered doctor blade unit 4 through another pressure regulator 56 ensuring a constant pressure in the inflatable hose 43 when using the chambered doctor blade unit 4, since overinking is not required this case, it is not necessary to vary the contact pressure of the doctor blades of this chambered doctor blade unit. When using the chambered doctor blade unit 5, the controller will be switched to the"control system" mode and the comparator 51 will, in accordance with the information Lc, Pr and Vr, send a signal Pbg to the pressure regulator 53, which will supply a modulated pressure Pm to the inflatable hose 43*a*. The scanner 54 is placed near of the printed sheet 57, travelling in the direction shown by the arrow 58, so as to read its lower surface.

It is obvious, from the reading of the present description, that a major cost reduction can be achieved through use of this inking station, due to use of a large number of common pieces with both inking modes. Moreover, through the choice of the combination of two systems using doctor blades in this way improvement of print quality is obtained, which has not been previously observed with the employed technologies applied separately.

I claim:

1. A multifunctional inking station for a flexographic printing machine adapted to print workpieces comprising webs or sheets of paper, cardboard or corrugated cardboard, said inking station comprising (a) a plate cylinder (2) for applying an image to the workpieces, (b) a textured cylinder (3) for transferring a determined quantity of ink to selected portions of the plate cylinder, and (c) means for supplying the determined quantity of ink to the textured cylinder (3), in which the means for supplying the determined quantity of ink to the textured cylinder (3) comprises at least two chambered doctor blade units (4,5) placed facing one another on either side of the textured cylinder (3), the doctor blade units differing from one another in stiffness, composition, or mounting angle of their respective doctor blades, and means for selectably engaging one of the two chambered doctor blade units with the textured cylinder in accordance with the kind of printing job to be performed, whereby the textured cylinder (3) in use is always the same whatever the printing job may be without having to replace the textured cylinder (3).

2. An inking station of claim 1, in which one of the chambered doctor blade units (4) is equipped with stiffer doctor blades (37,38) for almost complete wiping of the surface of the textured cylinder (3) and the other chambered doctor blade unit (5) is equipped with less stiff doctor blades **(37*a*, 38*a*) for overinking the textured cylinder (3) through application of the determined thickness of ink film on the surface of the textured cylinder (3)**.

3. An inking station of claim 2, in which the stiffer chambered doctor blade unit (4) for almost complete wiping of the surface of the textured cylinder (3) is equipped with doctor blades (37,38) made of steel strip.

4. An inking station of claim 2, in which the less stiff chambered doctor blade unit (5) for overinking by application of a determined thickness ink film on the surface of the textured cylinder (3) is equipped with plastic doctor blades **(37*a*, 38*a*)**.

5. An inking station of claim 2, in which the doctor blades **(37, 38, 37*a*, 38*a*) of both chambered doctor blade units (4,5)** are made of low coefficient of friction plastic material.

6. An inking station of claim 2, comprising means for controlling the contact pressure of the doctor blades **(37*a*, 38*a*) of the chambered doctor blade unit (5) against the surface of the textured cylinder in accordance with the operating speed of the printing machine, for application of the determined thickness of ink film on the surface of the textured cylinder (3), so as to control the thickness of the ink film applied to the textured cylinder (3)**.

* * * * *